US012577946B2

(12) United States Patent
Weingarten et al.

(10) Patent No.: US 12,577,946 B2
(45) Date of Patent: Mar. 17, 2026

(54) PROPORTIONAL ADDITIVE DOSING PUMP WITH BIDIRECTIONAL ROLLING DIAPHRAGM

(71) Applicant: Tefen Flow and Dosing Technologies LTD., Kibbutz Nachsholim (IL)

(72) Inventors: Zvi Weingarten, Evron (IL); Gideon Sagi, Kfar Vradim (IL)

(73) Assignee: Tefen Flow and Dosing Technologies LTD., Kibbutz Nachsholim (IL)

( * ) Notice: Subject to any disclaimer, the term of this patent is extended or adjusted under 35 U.S.C. 154(b) by 127 days.

(21) Appl. No.: 18/418,295

(22) Filed: Jan. 21, 2024

(65) Prior Publication Data

US 2025/0237213 A1 Jul. 24, 2025

(51) Int. Cl.
*F04B 53/02* (2006.01)
*F04B 19/04* (2006.01)
*F04B 53/14* (2006.01)

(52) U.S. Cl.
CPC ..... *F04B 53/02* (2013.01); *F04B 19/04* (2013.01); *F04B 53/14* (2013.01)

(58) Field of Classification Search
CPC ..... F04B 53/02; F04B 53/14; F04B 53/16; F04B 19/04; F04B 13/00; F04B 9/105; F04B 43/02; F04B 43/14; F04B 45/04; F04B 45/045; C02F 1/686
USPC ..... 417/437
See application file for complete search history.

(56) References Cited

U.S. PATENT DOCUMENTS 3,309,967 A * 3/1967 Taplin ..... F16J 3/06 92/101
3,589,839 A * 6/1971 Johnson ..... F01L 33/04 91/347
3,853,431 A * 12/1974 Goodhart ..... F04B 9/105 417/403
4,569,378 A * 2/1986 Bergandy ..... B65B 3/32 141/89
9,726,170 B1 * 8/2017 Nickel ..... F04B 53/143
2004/0036045 A1 * 2/2004 Weingarten ..... F16K 17/0453 251/61.5

* cited by examiner

*Primary Examiner* — Mark A Laurenzi
*Assistant Examiner* — Kelsey L Stanek
(74) *Attorney, Agent, or Firm* — Rivka Friedman

(57) ABSTRACT

A hydraulic proportional additive dosing pump (ADP) has a plunger associated with an actuator rod and displaceable along a cylinder. A bidirectional roll diaphragm is deployed between an internal surface of the cylinder and an outer surface of the plunger so as to form a rolling seal between upper and lower chambers of the cylinder. An additive pump is driven by motion of the actuator rod. A switchable valve arrangement directs inlet water pressure alternately to the upper chamber and the lower chamber, switching at end of each stroke. The bidirectional roll diaphragm is deployed such that, for at least part of the down-stroke and for at least part of the up-stroke, a majority of an area of the bidirectional roll diaphragm is supported in contact with either the cylinder or the plunger.

5 Claims, 4 Drawing Sheets

PROPORTIONAL ADDITIVE DOSING PUMP WITH BIDIRECTIONAL ROLLING DIAPHRAGM

FIELD AND BACKGROUND OF THE INVENTION

The present invention relates to additive dosing pumps and, in particular, it concerns a proportional additive dosing pump with a bidirectional rolling diaphragm.

Additive dosing pumps are used to introduce additives into a flow of liquid, typically water, in various applications, such as for adding fertilizers and pesticides to irrigation water in agriculture, and for adding veterinary treatments or dietary supplements in drinking water for livestock. In order to avoid the need for electrical power, many additive dosing pumps are implemented as hydraulically-powered proportional dosing pumps, where the water flow is used to drive a pump which introduces the additive to the water flow in a constant proportion to the volume of water passing through the device.

The additive pump is typically driven by a piston that is displaced bidirectionally by pressure of water from an inlet that is alternately delivered to the two ends of a cylinder by an arrangement of valves. This structure is simple, reliable and highly effective under a range of operating conditions. However, the sliding seal of a piston within a cylinder is typically imperfect and, particularly for very low water flow rates, the rate of leakage around the piston may sometimes approach the required flow rate, leading to stalling of the pump and a failure to introduce the additive.

An alternative approach employed in certain hydraulically-powered proportional ADPs is to employ a diaphragm deployed in a control cavity to generate bidirectional motion to drive the proportional ADP. Use of a diaphragm is advantageous at low flow rates, since the peripheral seals of a diaphragm are static seals (in contrast to the sliding seals of a piston), and therefore do not suffer from the leakage problems of sliding seals. However, the diameter of a dish-like diaphragm needs to be much larger than a piston for the same length of stroke, resulting in a significantly larger and bulkier pump than a comparable piston implementation.

SUMMARY OF THE INVENTION

The present invention is a hydraulic proportional additive dosing pump (ADP) driven by a flow of water from an inlet to an outlet to introduce a proportional dose of a liquid additive into the flow of water.

According to the teachings of an embodiment of the present invention there is provided, a hydraulic proportional additive dosing pump (ADP) driven by a flow of water from an inlet to an outlet to introduce a proportional dose of a liquid additive into the flow of water, the ADP comprising: (a) a cylinder; (b) a plunger displaceable axially within the cylinder and subdividing the cylinder into an upper chamber and a lower chamber, the plunger having a cylindrical outer surface, the plunger being rigidly associated with an actuator rod; (c) a bidirectional roll diaphragm deployed at least partially in a gap between an internal surface of the cylinder and the outer surface of the plunger, the bidirectional roll diaphragm sealingly interconnected with the cylinder and with the plunger so as to form a rolling seal between the upper chamber and the lower chamber; (d) a pump body having a water inlet, a water outlet, and defining a plurality of flow paths from the water inlet to the upper chamber and the lower chamber, and from the upper chamber and the lower chamber to the water outlet; (e) an additive pump having an additive inlet for drawing a quantity of the liquid additive and an outlet for releasing the liquid additive into a water flow within the pump body, the additive pump being driven by motion of the actuator rod; and (f) a switchable valve arrangement associated with the plurality of flow paths and with the actuator rod, the valve arrangement switchable between a first state in which: the flow path from the water inlet to the upper chamber is open; the flow path from the water inlet to the lower chamber is closed; the flow path from the upper chamber to the outlet is closed; and the flow path from the lower chamber to the outlet is open, thereby applying an inlet pressure above the plunger to power a down-stroke of the plunger, and a second state in which: the flow path from the water inlet to the lower chamber is open; the flow path from the water inlet to the upper chamber is closed; the flow path from the lower chamber to the outlet is closed; and the flow path from the upper chamber to the outlet is open, thereby applying an inlet pressure below the plunger to power an up-stroke of the plunger, the valve arrangement being toggled between the first and second states at end positions of the down-stroke and the up-stroke so as to generate reciprocating motion of the plunger, wherein the bidirectional roll diaphragm is deployed such that, for at least part of the down-stroke and for at least part of the up-stroke, a majority of an area of the bidirectional roll diaphragm is supported in contact with either the cylinder or the outer surface of the plunger as a region of convolution rolls along the bidirectional roll diaphragm.

According to a further feature of an embodiment of the present invention, the bidirectional roll diaphragm is sized such that, at the end of at least one of the down-stroke and the up-stroke, the region of convolution is at least partially straightened so as to turn through less than 180 degrees.

According to a further feature of an embodiment of the present invention, the bidirectional roll diaphragm is sized such that, at the end of at least one of the down-stroke and the up-stroke, a region of interconnection of the bidirectional roll diaphragm with the cylinder and a region of interconnection of the bidirectional roll diaphragm with the plunger are at opposite axial extremities of the bidirectional roll diaphragm.

According to a further feature of an embodiment of the present invention, the down-stroke and the up-stroke have a stroke length, and wherein the cylindrical outer surface of the plunger extends on each side of a region of interconnection of the bidirectional roll diaphragm with the plunger to an axial length of between 30 percent and 50 percent of the stroke length.

According to a further feature of an embodiment of the present invention, at the end of each of the down-strokes and at the end of each of the up-strokes, a majority of an area of the bidirectional roll diaphragm is supported by the internal surface of the cylinder and, after switching of the valve arrangement, a majority of an area of the bidirectional roll diaphragm is supported by the outer surface of the plunger.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a hydraulic proportional additive dosing pump driven by a flow of water from an inlet to an outlet to introduce a proportional dose of a liquid additive into the flow of water.

The principles and operation of ADPs according to the present invention may be better understood with reference to the drawings and the accompanying description.

Figure 1A:
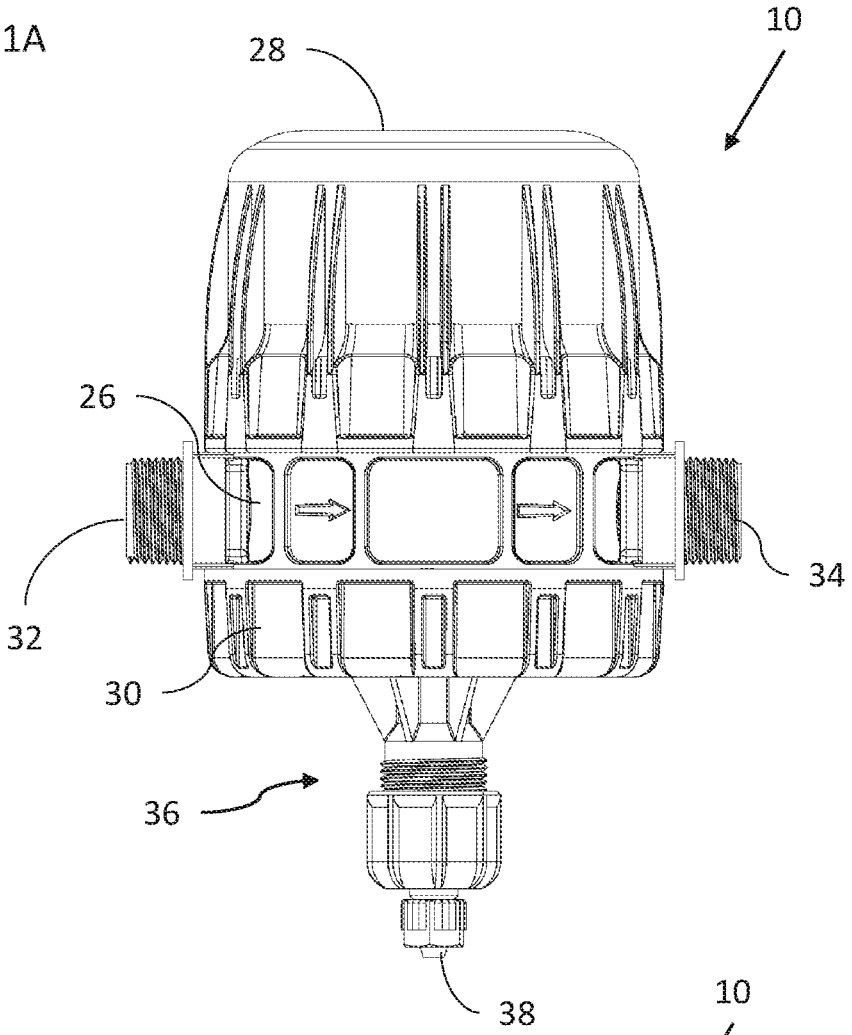
FIG. 1A is a side view of a hydraulic proportional additive dosing pump, constructed and operative according to the teachings of an embodiment of the present invention, driven by a flow of water from an inlet to an outlet to introduce a proportional dose of a liquid additive into the flow of water.
Figure 1B:
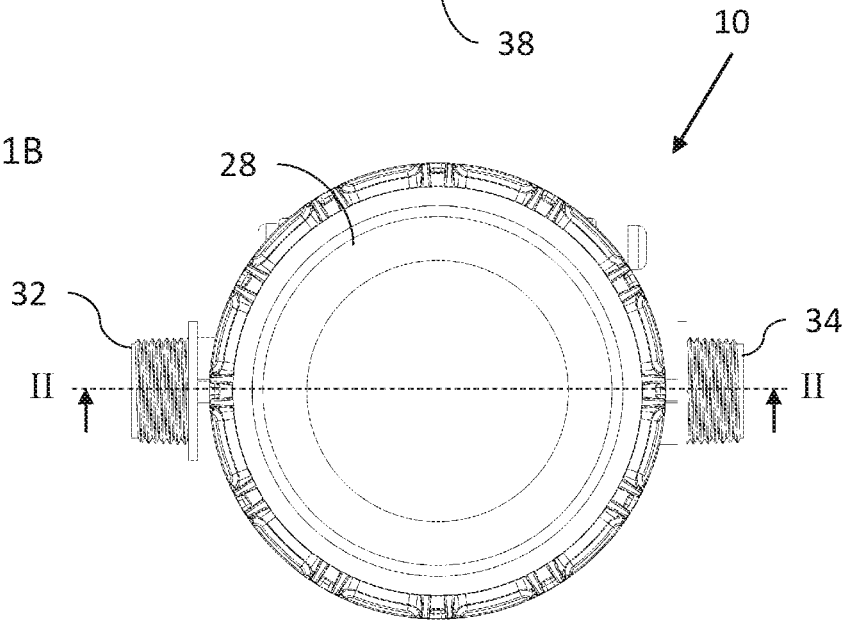
FIG. 1B is a top view of the hydraulic proportional additive dosing pump of FIG. 1A.
Figure 2:
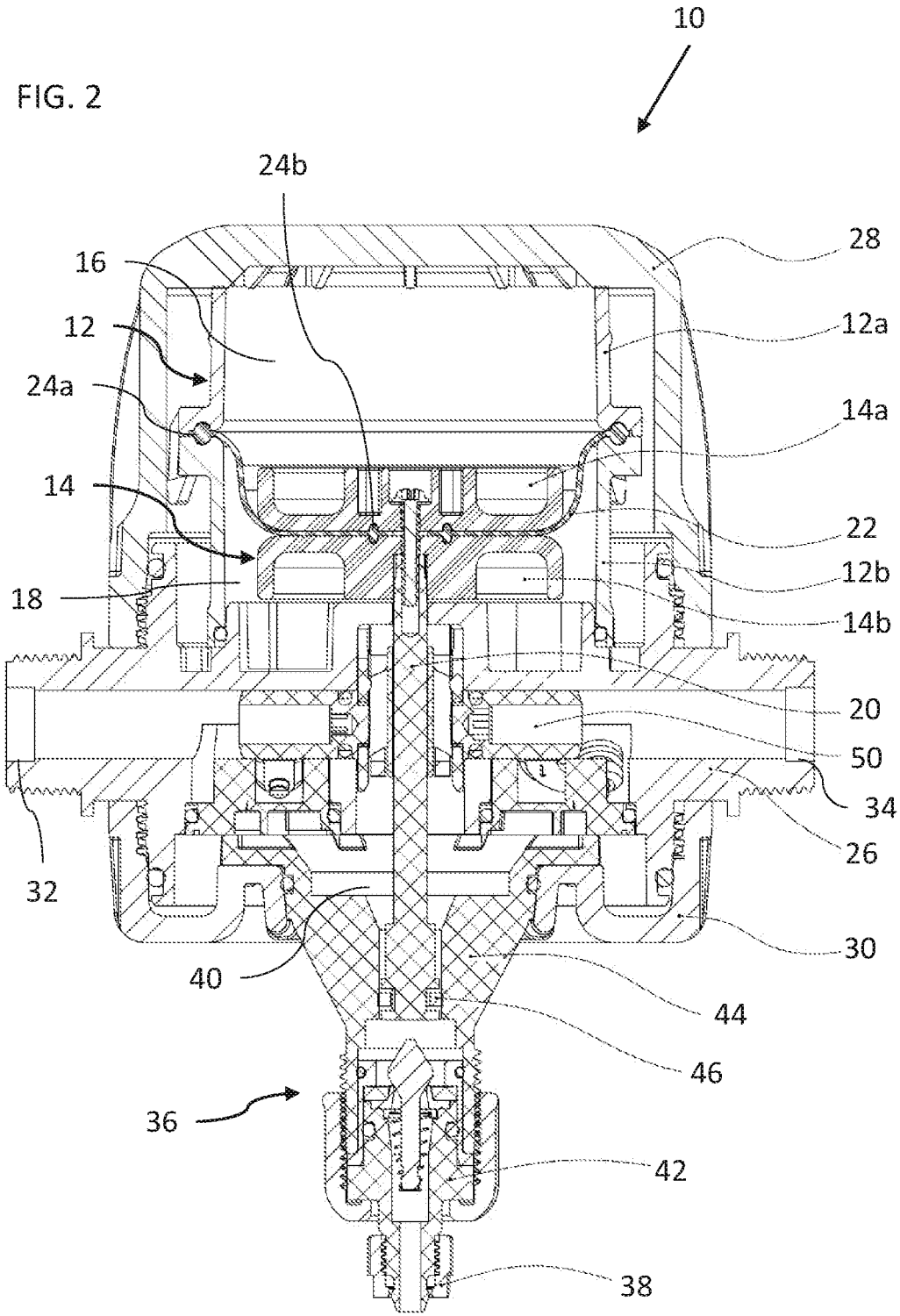
FIG. 2 is a cross-sectional view taken along the line II-II in FIG. 1B.

Referring now to the drawings, FIGS. 1A-2 illustrate a hydraulic proportional additive dosing pump (ADP), generally designated 10, constructed and operative according to an embodiment of the present invention, driven by a flow of water from an inlet to an outlet to introduce a proportional dose of a liquid additive into the flow of water. Various features and functionality of ADP 10 are illustrated in a schematic manner in subsequent FIGS. 3A-4F in order to facilitate understanding.

In general terms, and as seen in FIG. 2, ADP 10 includes a cylinder 12 which, in this implementation, is assembled from an upper cylinder portion 12*a* and a lower cylinder portion 12*b*, and a plunger 14 which, in this implementation, is assembled from an upper plunger portion 14*a* displaceable axially within the cylinder and subdividing the internal volume of the cylinder into an upper chamber 16 and a lower chamber 18. Plunger 14 has a cylindrical outer surface, and is rigidly associated with an actuator rod 20. A roll diaphragm 22, deployed at least partially in a gap between an internal surface of cylinder 12 and the outer surface of plunger 14, is sealingly interconnected with cylinder 12 and with plunger 14 so as to form a rolling seal between upper chamber 16 and lower chamber 18. In the non-limiting example illustrated here, roll diaphragm 22 is sealingly interconnected with cylinder 12 by clamping of a bead 24*a* of the roll diaphragm between cylinder portions 12*a* and 12*b*. Similarly, in the non-limiting example illustrated here, roll diaphragm 22 is sealingly interconnected with plunger 14 by clamping of a bead 24*b* between plunger portions 14*a* and 14*b*.

A pump body, here assembled from a central pump body 26, a pump body cover 28 and a pump body base 30, has a water inlet 32 and a water outlet 34. The pump body defines a plurality of flow paths from water inlet 32 to upper and lower chambers 16 and 18, and from upper and lower chambers 16, 18 to water outlet 34.

ADP 10 also includes an additive pump 36 having an additive inlet 38, here configured for attachment of a suction tube, for drawing a quantity of the liquid additive and an outlet 40 for releasing the liquid additive into a water flow within the pump body. Additive pump 36 is driven by motion of actuator rod 20. In the particular implementation illustrated here, a suction check valve 42 allows one-directional uptake flow from additive inlet 38 into a dosing cylinder 44, and a one-way seal 46 is mounted near a lower end of actuator rod 20. As a result, each upward stroke of actuator rod 20 draws in a known volume of liquid additive via suction check valve 42, and the subsequent downward stroke (after initial priming to fill any dead-space) forces that volume of the additive past one-way seal 46 so as to be released from outlet 40 into the primary water flow through the pump.

A switchable valve arrangement controls the various flow paths synchronously with the plunger motion in order to generate reciprocating motion of the plunger. The region of the switchable valve arrangement is indicated generally by reference numeral 50 in FIG. 2, but the details are not visible in this view. In order to facilitate an understanding of valve arrangement 50, reference is made to the schematic and simplified views of FIGS. 3A and 3B.

Figure 3A:
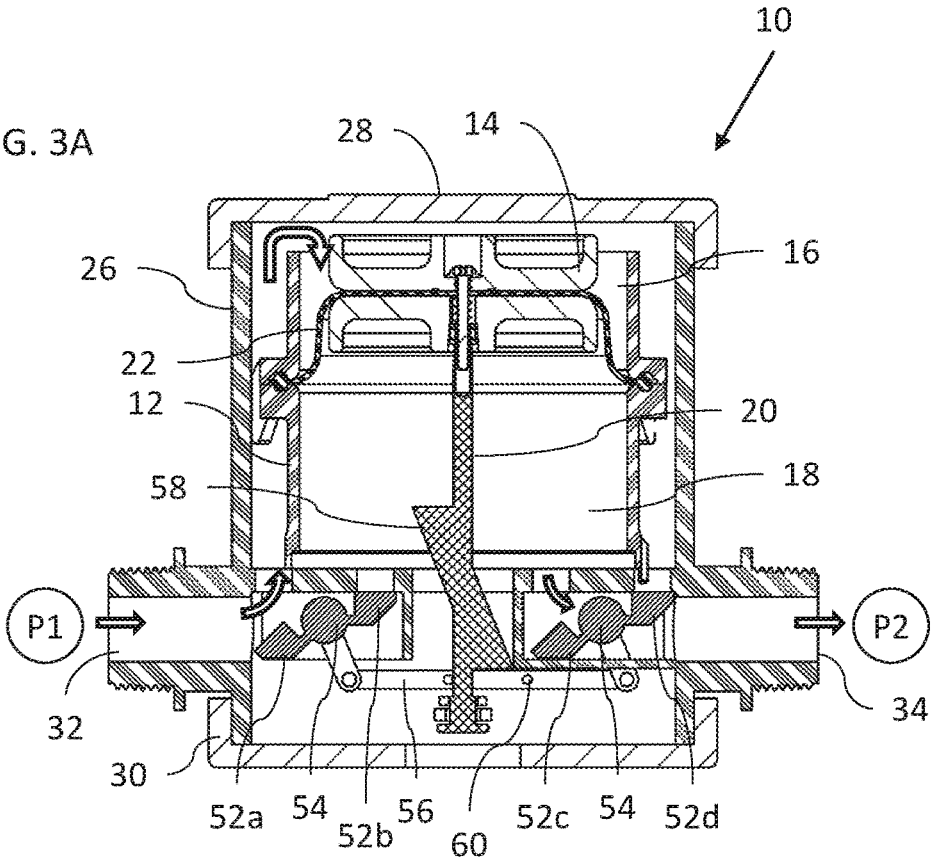
FIGS. 3A and 3B are schematic partial cross-sectional views similar to FIG. 2 modified to illustrate schematically the principles of operation of a switchable valve arrangement.
Figure 3B:
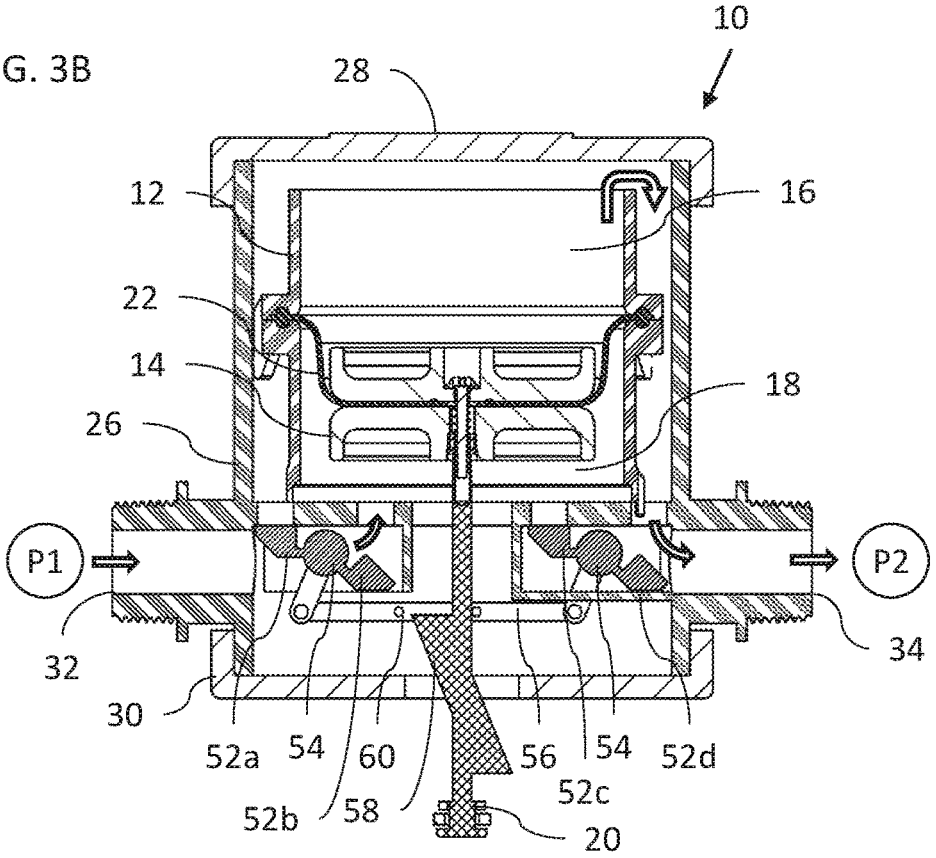

FIGS. 3A and 3B are partial, simplified, schematic cross-sectional views of ADP 10 in which the valves 52*a*, 52*b*, 52*c* and 52*d* of valve arrangement 50 are all illustrated in the plane of a single cross-section for ease of presentation. The valve arrangement 50 is switchable between a first state, illustrated in FIG. 3A, and a second state illustrated in FIG. 3B. In the first state, valve 52*a* is open, leaving open a flow path from water inlet 32 to upper chamber 16, while valve 52*b* is closed, thereby blocking a flow path from water inlet 32 to lower chamber 18. On the outlet side, valve 52*d* is closed, thereby blocking a flow path from upper chamber 16 to outlet 34, while valve 52*c* is open, leaving open a flow path from lower chamber 16 to outlet 34. This first state therefore results in an inlet pressure P1 being applied above plunger 14 to power a down-stroke of the plunger while water from lower chamber 18 is expelled at lower outlet pressure P2. In the second state, valve 52*b* is open, leaving open the flow path from water inlet 32 to lower chamber 18, while valve 52*a* is closed, thereby blocking the flow path from water inlet 32 to upper chamber 16. On the outlet side, valve 52*c* is closed, thereby blocking the flow path from lower chamber 18 to outlet 34, while valve 52*d* is open, thereby leaving open the flow path from upper chamber 18 to outlet 34. This second state therefore results in the inlet pressure P1 being applied below plunger 14 to power an up-stroke of the plunger, while water from upper chamber 16 is expelled at lower outlet pressure P2. Simultaneous switching of the valves may conveniently be achieved by mounting the valve plugs on pivotally-mounted rockers 54 which alternately open and close each valve through a rocking motion.

The two rockers 54 are preferably mechanically interconnected via a bridging element 56. The bridging element is preferably displaced towards the end of each stroke of the actuator rod 20, thereby toggling (switching) the state of the valves at the end of each stroke and reversing the pressure differential on the plunger. The reversal of the pressure differential at the end of each stroke generates reciprocating motion of the plunger. A mechanism for switching the valve arrangement back and forth at the end of the plunger strokes is illustrated here schematically as wedge-shaped actuating surfaces 58 which act on pins 60 projecting from bridging element 56 so as to displace bridging element 56 laterally. A resilient bistable mechanism (not shown) is preferably deployed in order to maintain the valves in one or other of the above two states, and to ensure a rapid snap-motion between the two states.

It is a particular feature of certain preferred embodiments of the present invention that a single roll diaphragm 22 is used bidirectionally, i.e., where the direction of pressure differential is reversed during use, and the same roll diaphragm acts in both directions. This is an unusual mode of use of a roll diaphragm. Typically, a roll diaphragm is actuated only with a single direction of pressure differential, and any return motion is actuated by a spring. Alternatively, in some cases, two separate roll diaphragms are sometimes deployed within a single cylinder operating in opposite directions, where each diaphragm is actuated in only one direction. In contrast, the present invention provides a truly bidirectional roll diaphragm configuration.

For the purpose of the description and claims, the term "roll diaphragm" is used to refer to a diaphragm deployed in a gap between an internal surface of a cylinder and an outer cylindrical surface of a plunger, for which, over at least part of the working stroke, a majority of an area of the diaphragm is supported in contact with either the cylinder surface or the cylindrical surface of the plunger as a region of convolution, corresponding to a 180 degree curve, rolls along the roll diaphragm. In this context, the "area" of the diaphragm is considered to be only the active, flexible area of the diaphragm, disregarding any part of the diaphragm structure which is clamped between the portions of the cylinder and/or the plunger. The surfaces referred to as "cylindrical" need not be precisely parallel to the axis, but should be sufficiently close to cylindrical (e.g., within 10 degrees, and more preferably 5 degrees to the axis) to provide the rolling functionality of the roll diaphragm.

Figure 4A:
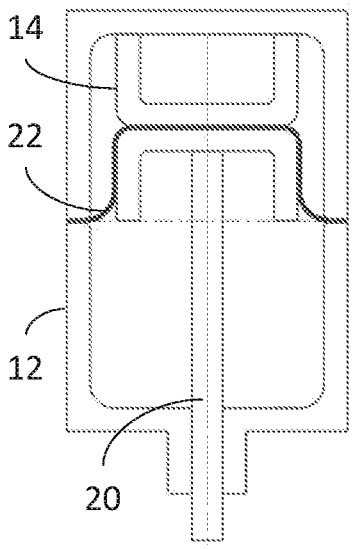
FIGS. 4A-4F are schematic cross-sectional views illustrating a sequence of states of a bidirectional roll diaphragm from the hydraulic proportional additive dosing pump of FIG. 1A during a cycle of a downwards stroke followed by an upwards stroke.
Figure 4B:
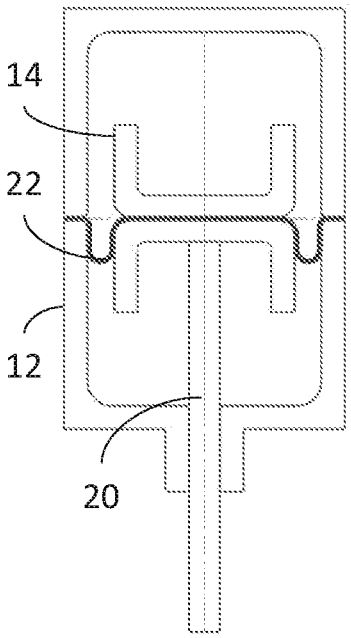
Figure 4C:
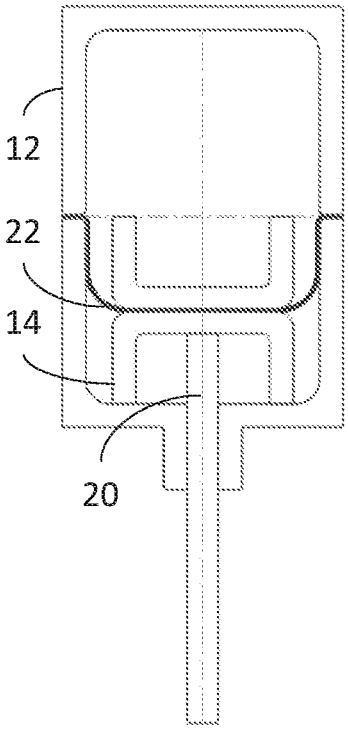
Figure 4D:
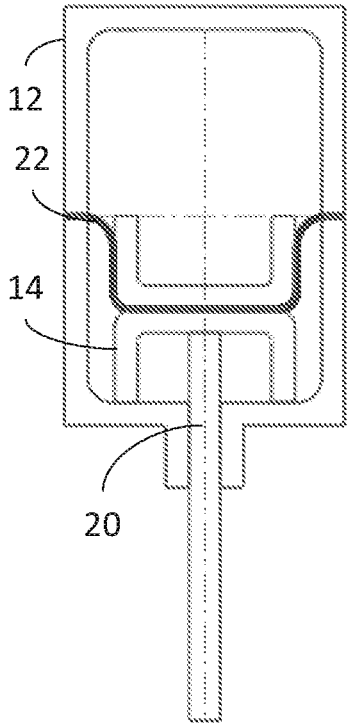
Figure 4E:
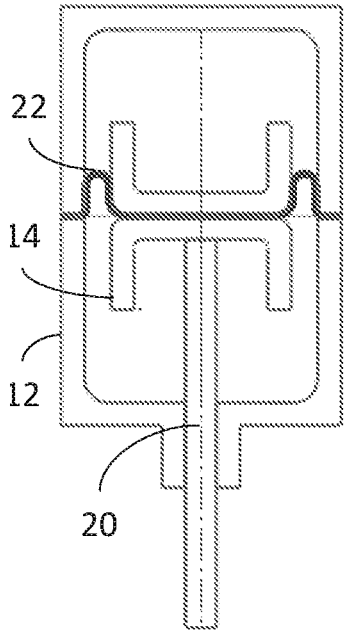
Figure 4F:
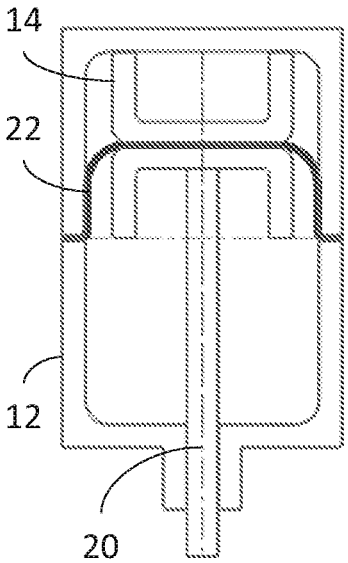

The dynamic functionality of roll diaphragm 22 during bidirectional use is illustrated schematically in FIGS. 4A-4F. FIGS. 4A-4C illustrate the beginning, middle and end of a downwards stroke, where the inlet pressure P1 is applied to the upper chamber 16. At the beginning of the stroke (FIG. 4A), the pressure forces a majority of the area of the roll diaphragm against the cylindrical surface of the second plunger portion 14*b* and then the pressure starts to displace the plunger downwards. During this motion, the diaphragm progressively "rolls" onto the internal surface of cylinder 12 as the convolution moves along the diaphragm, lifting the diaphragm away from the surface of the plunger until, at the end of the motion, a majority of the diaphragm area is pressed against the internal surface of cylinder 12 (FIG. 4C). When the pressure is reversed, applying inlet pressure P1 to lower chamber 18, a majority of the area of roll diaphragm 22 is again pressed against the cylindrical surface of plunger 14 (this time against the surface of first plunger portion 14*a*) as shown in FIG. 4D, and the pressure then starts to displace the plunger in the upward motion. Once again, the motion is accompanied by a progressive rolling of the diaphragm via the convolution onto the internal surface of the cylinder 12 (FIG. 4E) until a majority of the diaphragm area is pressed against the cylinder (FIG. 4F). A second reversal of the pressure differential then again presses the diaphragm inwards against the plunger, returning to the state of FIG. 4A to commence a further bidirectional cycle.

Optionally, the roll diaphragm may be left with a convolution region having a full 180-degree curve at the end of its stroke in one or both directions. In this case, reversal of the direction of pressure differential will invert this lobe of the convolution region so that the diaphragm balloons to form the convolution region at the other axial extremity of the diaphragm. This option is expected to be fully operative, but may impose relatively large strain on the diaphragm during switching of direction, and requires a larger volume of water to invert the diaphragm during reversal of direction before motion of the plunger will start.

As a particularly preferred but non-limiting alternative, the roll diaphragm may advantageously be sized such that, at the end of the stroke in one or both directions, the region of convolution is at least partially straightened so as to turn through less than 180 degrees. In certain preferred cases, the roll diaphragm is sized such that, at the end of the stroke in one or both directions, the region of interconnection of roll diaphragm 22 with cylinder 12 and the region of interconnection of roll diaphragm 22 with plunger 14 are at opposite axial extremities of the roll diaphragm. This has the effect of completely eliminating the "bulge" of the region of convolution at the ends of the stroke, instead forming an S-curve approximating to 90 degrees deflection at each end. This configuration minimizes the volume of water required to reverse the diaphragm working direction, and minimizes stress on the diaphragm during the reversal of pressure differential.

The axial length of the cylindrical outer surfaces of plunger 14 should be chosen according to the roll diaphragm design and the length of the stroke so as to provide full support of the roll diaphragm at the beginning of each stroke. Preferably, the cylindrical outer surface of the plunger extends on each side of the region of interconnection of the roll diaphragm with the plunger to an axial length of between 30 percent and 50 percent of the full stroke length over which the plunger moves.

The roll diaphragm is preferably formed from suitable elastomers known in the art for implementation of flexible diaphragms. In certain implementations, because of the relatively large strain experienced by the diaphragm during reversal of the pressure differential, it may be preferably to employ a diaphragm implemented as an unreinforced layer of an elastomer, thereby avoiding risk of delamination.

It will be appreciated that the above descriptions are intended only to serve as examples, and that many other embodiments are possible within the scope of the present invention as defined in the appended claims.

What is claimed is:

1. A hydraulic proportional additive dosing pump (ADP) driven by a flow of water from an inlet to an outlet to introduce a proportional dose of a liquid additive into the flow of water, the ADP comprising:

(a) a cylinder;

(b) a plunger displaceable axially within said cylinder and subdividing said cylinder into an upper chamber and a lower chamber, said plunger having a cylindrical outer surface, said plunger being rigidly associated with an actuator rod;

(c) a bidirectional roll diaphragm deployed at least partially in a gap between an internal surface of said cylinder and said cylindrical outer surface of said plunger, said bidirectional roll diaphragm sealingly interconnected with said cylinder and with said plunger so as to form a rolling seal between said upper chamber and said lower chamber;

(d) a pump body having a water inlet, a water outlet, and defining a plurality of flow paths from said water inlet to said upper chamber and said lower chamber, and from said upper chamber and said lower chamber to said water outlet;

(e) an additive pump having an additive inlet for drawing a quantity of the liquid additive and an outlet for releasing the liquid additive into a water flow within said pump body, said additive pump being driven by motion of said actuator rod; and (f) a switchable valve arrangement associated with said plurality of flow paths and with said actuator rod, said valve arrangement switchable between a first state in which: said flow path from said water inlet to said upper chamber is open; said flow path from said water inlet to said lower chamber is closed; said flow path from said upper chamber to said water outlet is closed; and said flow path from said lower chamber to said water outlet is open, thereby applying an inlet pressure above said plunger to power a down-stroke of said plunger, and a second state in which: said flow path from said water inlet to said lower chamber is open; said flow path from said water inlet to said upper chamber is closed; said flow path from said lower chamber to said water outlet is closed; and said flow path from said upper chamber to said water outlet is open, thereby applying an inlet pressure below said plunger to power an up-stroke of said plunger, said valve arrangement being toggled between said first and second states at end positions of said down-stroke and said up-stroke so as to generate reciprocating motion of said plunger, wherein said bidirectional roll diaphragm is deployed such that, for at least part of said down-stroke and for at least part of said up-stroke, a majority of an area of said bidirectional roll diaphragm is supported in contact with either said cylinder or said cylindrical outer surface of said plunger as a region of convolution rolls along said bidirectional roll diaphragm.

2. The ADP of claim 1, wherein said bidirectional roll diaphragm is sized such that, at the end of at least one of said down-stroke and said up-stroke, said region of convolution is at least partially straightened so as to turn through less than 180 degrees.

3. The ADP of claim 1, wherein said bidirectional roll diaphragm is sized such that, at the end of at least one of said down-stroke and said up-stroke, a region of interconnection of said bidirectional roll diaphragm with said cylinder and a region of interconnection of said bidirectional roll diaphragm with said plunger are at opposite axial extremities of said bidirectional roll diaphragm.

4. The ADP of claim 1, wherein said down-stroke and said up-stroke have a stroke length, and wherein said cylindrical outer surface of said plunger extends on each side of a region of interconnection of said bidirectional roll diaphragm with said plunger to an axial length of between 30 percent and 50 percent of said stroke length.

5. The ADP of claim 1, wherein at the end of each of said down-strokes and at the end of each of said up-strokes, a majority of an area of said bidirectional roll diaphragm is supported by said internal surface of said cylinder and, after switching of said valve arrangement, a majority of an area of said bidirectional roll diaphragm is supported by said cylindrical outer surface of said plunger.

* * * * *